United States Patent [19]

Parolini

[11] 4,132,287

[45] Jan. 2, 1979

[54] SUPPORT ASSEMBLY

[76] Inventor: Sammy H. Parolini, P.O. Box 235, Mulberry, Fla. 33860

[21] Appl. No.: 766,221

[22] Filed: Feb. 7, 1977

[51] Int. Cl.[2] ..... E04G 3/12; E04G 3/10

[52] U.S. Cl. ..... 182/45; 182/142

[58] Field of Search ..... 182/45, 36, 37, 38, 182/142; 180/1 AW, 1 A; 280/43.2, 43.17

[56] References Cited

U.S. PATENT DOCUMENTS

| | | | |
|---|---|---|---|
| 677,645 | 7/1901 | Elkins | 182/45 |
| 710,281 | 9/1902 | Leek | 182/38 |
| 994,424 | 6/1911 | Prose | 182/45 |
| 2,231,560 | 2/1941 | Campion | 182/45 |
| 2,426,825 | 9/1947 | Geary | 182/45 |
| 3,029,886 | 4/1962 | Hansen | 180/1AW |

*Primary Examiner*—Reinaldo P. Machado
*Attorney, Agent, or Firm*—Duckworth, Hobby, Allen & Pettis

[57] ABSTRACT

A support assembly primarily designed to be connected in supporting relation to a scaffold and structured, through placement of its various components, to move the scaffold assembly along an inclined surface such as on a roof. The support assembly includes a frame and preferably at least two support wheels extending outwardly from said frame and into movable engagement with the inclined surface so as to support the frame thereon. A platform for interconnection to the scaffold element is movably and adjustably positioned on the frame by means of a platform positioning assembly which, through its interconnection to the platform, defines the platform's angular orientation relative to the plane. A plurality of platform positioning rollers are disposed in spaced apart relation to one another and movably adjustable to extend beyond the support wheels so as to supportingly engage the inclined surface in a manner to allow accomplishment of lateral movement of the frame in a direction substantially transverse to the longitudinal axis thereof so as to provide lateral positioning of the entire scaffold assembly as well as its vertical displacement along the inclined angle of the inclined surface.

10 Claims, 5 Drawing Figures

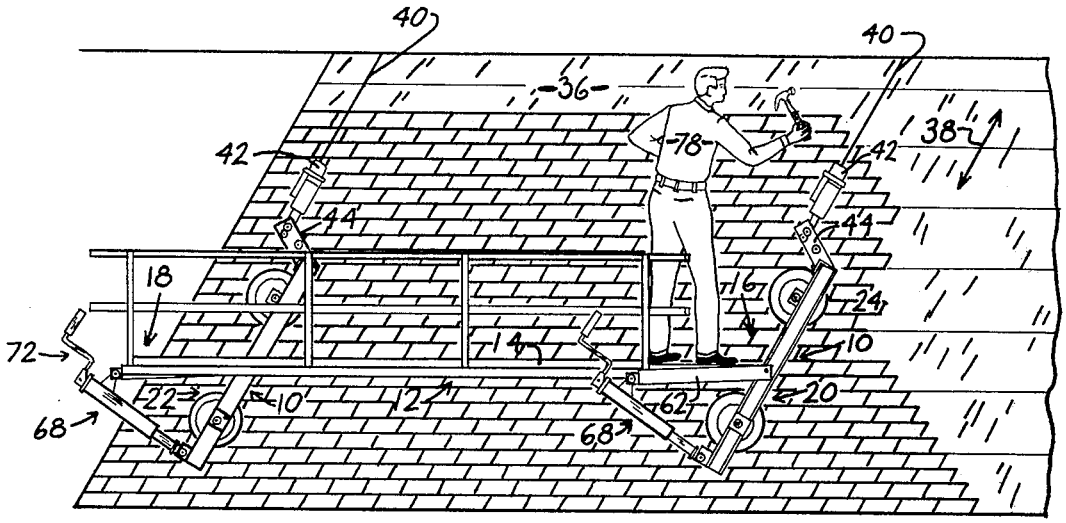
FIG 1
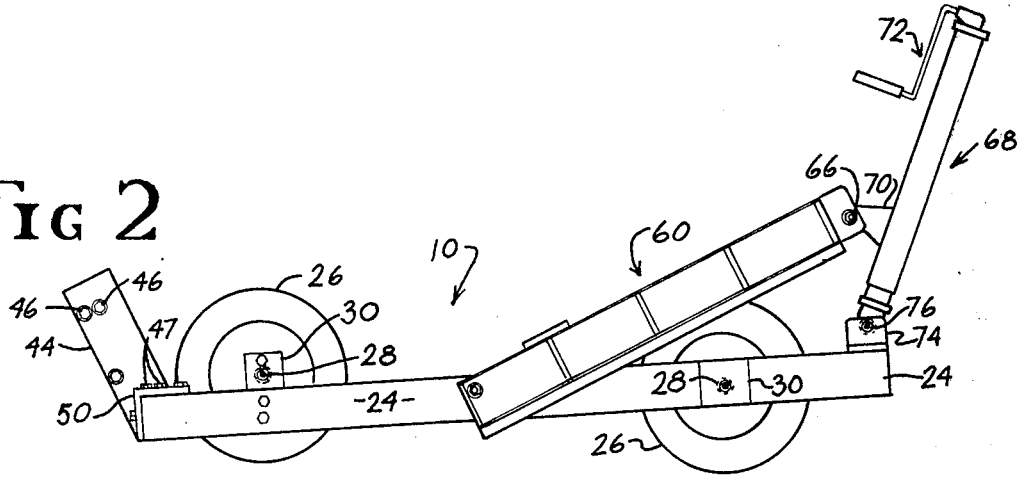
FIG 2
FIG 4
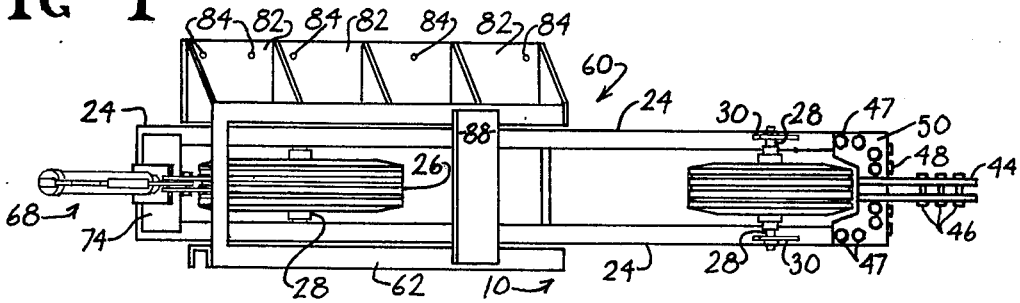

SUPPORT ASSEMBLY

BACKGROUND OF THE INVENTION

1. Field of the Invention

This invention relates to a support assembly primarily designed for use with a scaffolding element and commonly known in the trade as a roof jack wherein specific structural components are included to allow for the vertical positioning of the support assembly along the inclined surface of the roof as well as the lateral positioning of the scaffold assembly without dismantling or detachment of the major components of the support assembly.

2. Description of the Prior Art

In the installation, maintenance and/or repair of roof structures, it is common practice to utilize a movable scaffolding structure. This scaffolding structure comprises an adequate support platform surface to enable one or more workers to position themselves along predetermined portions of the inclined surface of a roof so as to accomplish their installation or maintenance activities. Commonly, the actual supporting scaffold element is a substantially elongated plank-like structure supported at spaced apart locations by movable "roof jacks" or support platforms. These support platforms or roof jacks are capable of being vertically positioned along the inclined surface of the roof and are further capable of being selectively moved so as to locate the workers on the scaffold at the desired location.

Conventional methods and prior art structure used to accomplish the above set forth activities relative to the laying of roofing materials on steep or inclined surfaces of the roof have been dangerous, time-consuming and difficult. In one of its simplest embodiments, one or more of the workmen working on a high, steep roof will generally lay the roofing materials while being supported on a relatively narrow plank-like element which is somehow anchored directly to the roof. The area which the worker can safely cover is, therefore, limited to the distance he can reach based on his own physical dimensions. In the past, after the worker has laid the roofing material in a predetermined area, it is necessary to repeat the procedure in other areas along the roof's surface which cannot be physically reached by the worker in his original position. This is accomplished by securing another supportive blank at a higher position and having the worker change his position so as to be supported on the added plank or board. Commonly, the only safety features involve the provision of tying a rope or like safety line around the worker's waist or torso. The free end of the rope is thrown over the ridge of the roof and tied securely to some anchoring means. Obviously, the purpose of such precaution is to save the roofer from serious injury should he slip from the narrow support plank or should the plank itself break.

In order to do away with such inconvenient and inefficient prior art structures, there has been an attempt in the industry over the past several years to develop a more mechanized scaffold support assembly.

Such prior art assemblies are generally disclosed in the U.S. patents to Van Horn, 2,814,533; Elkins, 677,645; Bartlett, 3,842,934; Campion, 2,231,560 and Campbell, 1,650,324.

All of the above-noted U.S. patents are directed toward some type of mechanized scaffold bracket or support assembly which is capable of being adjustably positioned in a substantially vertical, inclined direction along the plane defined by the inclined surface of the roof on which maintenance or installation is being conducted. While such prior art structures are usable in the general application as described above, these structures are generally considered to be overly complex and less than fully efficient in accomplishing ready and easy positioning of the assembly or scaffold bracket at desired locations along the surface of the roof.

One specific problem associated with such prior art devices is their inability to be re-oriented laterally along the roof's surface as well as vertically. This inherent disadvantage only allows the workmen to utilize such structures in repairing consecutively positioned sections of the roof. After a "vertical section" has been repaired or constructed, most of the support assemblies require major dismantling and relocating laterally so that the next vertical section can be worked on.

Accordingly, there is an obvious need in the roofing industry for a mechanized scaffold bracket or light support assembly which is capable of efficient, vertical positioning of the entire support scaffold assembly at various positions along the roof's surface while at the same time allowing the entire assembly, without dismantling or breakdown, to be laterally re-oriented to provide access to consecutive or successively positioned sections of the roof's surface.

SUMMARY OF THE INVENTION

This invention relates to a support assembly designed primarily for supporting a scaffold structure along the inclined surface of a roof or the like for the purpose of positioning workers to accomplish repair, installation or maintenance activities thereon. It should be noted that the support element referred to hereinafter as the scaffold element on which the bodies of the workers are actually supported is not, per se, a part of the subject invention. The support assembly herein described is disclosed in specific relation and operative connection with regard to the scaffold element so as to place the support assembly of the present invention in a preferred environment.

The support assembly of the present invention comprises a frame and a scaffold connecting means integrally formed thereto and disposed along essentially one side thereof. By virtue of the side placement of this scaffold connecting structure, the support assemblies and particularly the frames are referred to as right-hand and left-hand members. The scaffold connecting portion is specifically designed and configured to be readily attachable to an end or like portion of the support scaffold element. In the preferred embodiment and as described with regard to the drawings hereinafter, usually two of the support assemblies are used and disposed in connected relation to opposite ends of the support element wherein the support scaffold element is supported therebetween and movable along the inclined surface in a manner to be described in greater detail hereinafter.

Frame support means in the form of a plurality of wheels are movably attached to the frame. The plurality of wheels preferably comprise at least two wheels disposed in aligned, spaced apart relation to one another and each being rotatably mounted to the frame. Each of the support wheels are so positioned so as to extend outwardly from the underside of the frame and thereby be placed into movable, supportive engagement with the inclined surface of the roof relative to the frame.

An important structural feature of the invention comprises the provision of frame positioning means in the form of at least one but preferably a plurality of positioning rollers connected to the frame. Each of the rollers may comprise relatively smaller wheels, coasters, actual rollers or like structure which is capable of rotary motion along the inclined surface, as will be described in greater detail hereinafter. Roller adjusting means serve to interconnect the individual rollers to the frame in spaced apart relation to one another and substantially at opposite ends on the frame. These adjusting means may provide a screw jack or similar extension member which is specifically dimensioned to allow extension of the rollers beyond the undersurface of the frame a distance greater than the distance of projection of the support wheels. Accordingly, these positioning rollers are rotatably mounted to the adjusting means and, when disposed in their outwardly extending position, extend into supporting, moving engagement with the inclined surface so as to raise the frame and the support wheels above the surface and out of contact therewith. Therefore, when the positioning rollers are in their outermost extended position they comprise the primary source of support of the frame. Due to their rotational connection to the adjusting means they may move along the inclined surface of the roof in almost any direction. This, therefore, allows the lateral movement of the frame and, of course, the entire supporting assembly and the scaffold element and remaining structure attached thereto. Therefore, the entire scaffold assembly may be moved both laterally for proper repositioning by virtue of the provision of the positioning rollers as well as vertically for working activity through the provision of the support wheels. It should be obvious that when the positioning rollers are in their non-extended position the support wheels define the primary basis of movable support of the frame on the inclined surface of the roof.

A platform means is movably mounted on the frame and includes a scaffold connecting means integrally attached thereto. In the preferred embodiment, the scaffold connecting means comprises a bracket arrangement integrally attached along one longitudinal side of the platform. This scaffold connecting means is specifically structured and configured to engage one end or applicable portion of the scaffold support element itself for maintaining adequate support thereof. In actual structure, the various support assemblies include the platform means having the scaffold connecting means mounted on one but opposite sides thereof. Therefore, the individual support assemblies may be designated as right-hand or left-hand support assemblies and are specifically designed for supporting engagement with opposite ends of the support scaffold element. One end or applicable portion is pivotally connected to the frame itself while the opposite end or spaced apart applicable portion is pivotally attached to a platform positioning means. By virtue of this connection, the angular orientation of the platform means may be adjusted and defined relative to the frame. Therefore, while the frame is disposed in supported engagement on the inclined surface and is itself arranged at an angle to both true horizontal and vertical, the platform may be maintained level by virtue of adjusting its angular orientation to accomplish this level position relative to horizontal and vertical.

The platform positioning means may include a screw jack or like type structure capable of having a portion thereon extending along the length thereof to accomplish pivotal movement of the platform means relative to the frame and thereby define its angular orientation relative thereto. It should be clear that the specific position of an extension assembly on the platform positioning means relative to the longitudinal axis thereof will define the specific angular orientation. By virtue of this extension assembly being adjustable along the length of the platform positioning means, the angular orientation can be regulated and the level disposition of the platform means can be accomplished.

The invention accordingly comprises the features of construction, combination of elements, and arrangements of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which:

FIG. 1 is an elevational view of the support assembly attached to a scaffold structure with a worker appearing thereon.

FIG. 2 is a side view of the preferred embodiment of the present invention.

FIG. 4 is a top, plan view of the embodiment of FIG. 2.

Similar reference characters refer to similar parts throughout the several views of the drawings.

DETAILED DESCRIPTION

Figure 3:
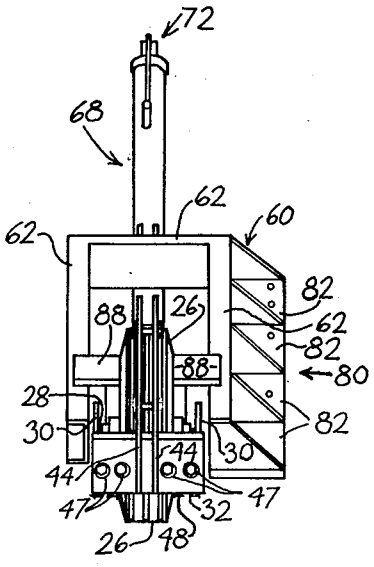
FIG. 3 is a front view of the embodiment of FIG. 2.

With reference to FIGS. 1–5, the support assembly of the present invention is generally indicated as 10 and is primarily designed to be mounted at opposite ends or in spaced relation to one another and concurrently support a scaffold structure generally indicated as 12 (FIG. 1) including scaffold element 14 having its opposite ends generally indicated as 16 and 18 attached to the right-hand support assembly 20 at one end and the left-hand support assembly 22 at the other.

For purposes of clarity, the support assembly of the present invention will be described with reference to the right-hand assembly as shown in FIGS. 2–5. However, as will become apparent hereinafter, the only difference existing is the particular placement of the scaffold connecting means on opposite sides of the platform.

Turning to the specific structure of the subject invention, each of the assemblies comprises a frame 24 being represented as having a substantially elongated configuration and having movable mounted thereon support means in the form of at least one and preferably a plurality of support wheels 26. Each of the support wheels are mounted on an axle 28 secured to the frame by brace elements or collars 30 so as to be rotatably attached to the frame. As noted in FIGS. 2, 4 and 5, the support wheels 26 are disposed in spaced apart relation to one another and are further disposed in substantially aligned, in-line relation. Also, disposition of each of the support wheels 26 on the frame 24 is such as to extend beyond the undersurface 32 a predetermined distance so as to movably support the frame 24 on the inclined surface of the roof generally indicated as 36. By virtue of the disposition of the support wheels 26, the various support assemblies 20 and 22 are movable in a generally vertical direction corresponding to the angle of inclination of the surface 36 as indicated by directional arrow 38.

Conventional attachment and/or support lines 40 are anchored or otherwise attached to the roof or on the opposite side thereof (not shown) at one end. The opposite end is operatively connected to lift mechanisms 42 which may be of conventional or prior art design. The lift mechanisms 42 are in turn attached to the attachment means 44 through proper and applicable connecting facilities as by connectors or the like 46. This attachment means comprises an outwardly extending arm member securely and fixedly attached to a leading portion 48 of the frame by an appropriate bracket or brace member 50. This brace member 50 may further serve to securely interconnect the various legs 52 which define the structure of the frame itself 24. Again, bolt or like connector elements 47 are properly placed on brace 50 as well as the remaining structural components of the frame 24 so as to effectively fasten the components to one another in a conventional manner.

Each of the support assemblies of the present invention further comprises platform means generally indicated as 60 and including a base 62 pivotally connected to frame 24 about pivot axle 64 as at 65. The opposite end or applicable spaced apart portion of the platform means 60 is pivotally attached as at 66 to the platform positioning means generally indicated as 68. More particularly, an extension assembly 70 is disposed to move along the length or longitudinal axis of the platform positioning means 68. In the particular embodiment shown, the platform positioning means comprises a screw jack operable by hand-manipulated handle 72 which in turn serves to raise or lower and thereby define the position of the extension assembly along the longitudinal axis or length of the platform positioning means 68. The platform positioning means 68 is itself pivotally mounted to frame 24 by mounting collar 74 as at 76. By virtue of the pivotal connection at 65, 66 and 76 of the platform means and platform positioning means 60 and 68, respectively, to the frame 24, the angular inclination or orientation of platform means 60 relative to frame 24 is determined by the position of extension assembly 70 along the length of the platform positioning means 68. As best shown in FIG. 1, it is obviously desirable to maintain the platform 60 in a level relationship to true horizontal and/or vertical so as to maintain the worker 78 in an upright position on the scaffold element 14. As stated above, the ends of the scaffold element 14 are interconnected to the right-hand and left-hand support assemblies 20 and 22.

This interconnection between scaffold element 14 and the platform 60 occurs through the provision of scaffold attachment means generally indicated as 80 integrally attached to one side of the base 62 of the platform means 60. In the particular embodiment shown, a plurality of pockets 82 serve to define at least a portion of the scaffold attachment means 80. Also, the attachment means 80 is disposed along one side of the platform base 62 and thereby defines whether the individual support assembly 10 comprises a right-hand support assembly 20 or a left-hand support assembly 22. The actual scaffold element 14 may be secured to the scaffold attachment means 80 by means of a plurality of attachment apertures 84 and through the use of conventional connector elements (not shown).

Further structural features of the present invention comprise a brace member 88 attached to opposite leg portions of the platform base 62 as shown in FIGS. 3 and 4. This brace is specifically positioned so as to strengthen the platform base 62 and/or aid in securing of the scaffold element 14 thereto.

Figure 5:
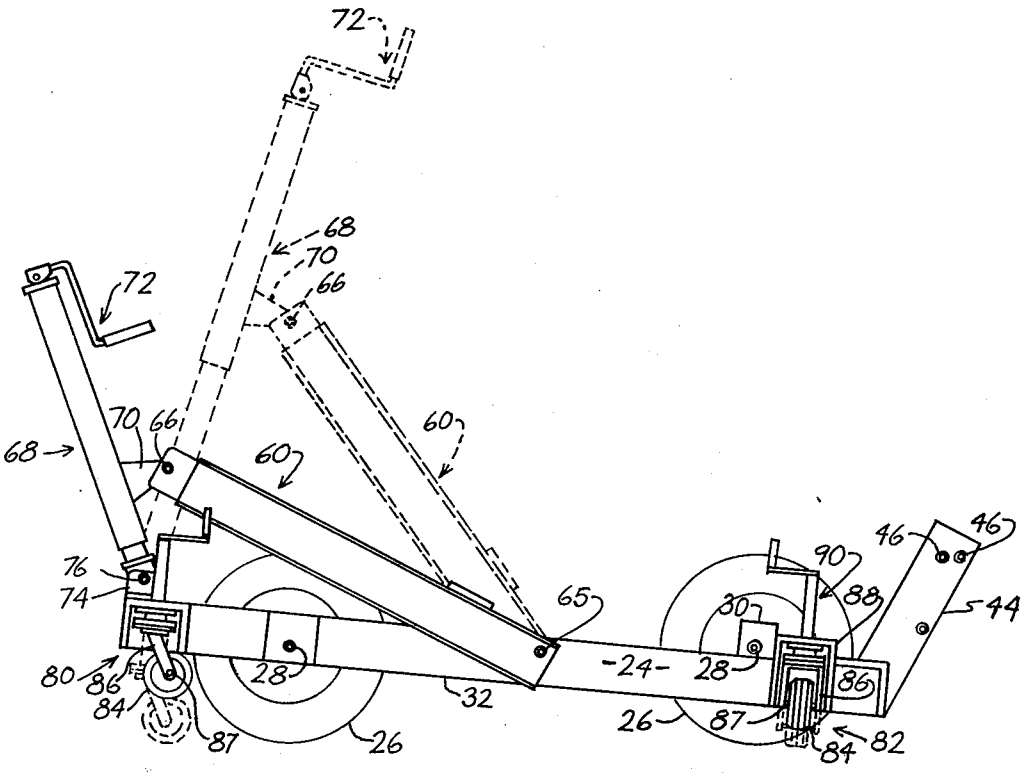
FIG. 5 is a side view of another embodiment of the present invention showing details of the positioning roller structure of the present invention.

Another important feature of the invention is best shown in FIG. 5 and comprises frame positioning means preferably in the form of one or more roller assemblies generally indicated as 80 and 82. Each of the roller assemblies includes a roller element 84 rotatably mounted to the rest of the assembly by bracket 86 and suspended on axle 87. Each of the roller assemblies are connected to the frame by a mounting collar 88 and are movably attached thereto in an adjustable, downwardly extending position relative to the underside 32 of frame 24 by the roller positioning means generally indicated as 90. This roller positioning means includes an extension member which may be in the form of a screw jack or any other applicable structure capable of disposing each of the positioning roller elements 84 in their downwardly extended position as represented in broken lines in FIG. 5. In this downwardly extended position each of the roller elements extend beyond the wheels 26 so as to be positioned in movable and supportive relation to frame 24 relative to the inclined roof surface. Accordingly, in this downwardly extended position, the frame is supported on the individual positioning roller elements 84 rather than on the support wheels 26. Because the rollers 84 are rotatably attached to the frame in a caster-like construction and further in view of the fact that the wheels 26 will not be engaging the roof surface when the rollers are in their downwardly extended position, the frame as well as the scaffold structure attached thereto is capable of moving laterally or in directions not limited to the incline of the roof surface. This allows the frame and the scaffold to be repositioned so as to provide access to various segments of the roof without dismantling or breaking down of the entire support assembly frame and/or scaffold structure attached thereto.

Naturally, when the rollers are in their non-extended position as shown in solid lines in FIG. 5, the support wheels 26 comprise the primary basis of movable support of frame 24 and the attached scaffold structure along the inclined surface 36 of the roof as shown in FIG. 1. It should be noted that while the positioning means are herein described with reference to roller elements 84, these roller elements can take the form of any type of wheel, caster, or movable roll or roller element which is capable of movably supporting the frame across a surface in the manner described above. Similarly, the adjusting means generally indicated as 90 may take any applicable form capable of allowing extension of the roller elements 84 into and out of the defined extended position as clearly shown in broken lines in FIG. 5.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A support assembly of the type primarily designed to movably position a scaffold element relative to an inclined surface, said support assembly comprising: a frame, frame support means movably connected to said frame and extending outwardly therefrom into movable engagement with the inclined surface; platform means movably mounted on said frame, platform positioning means movably interconnected to both said platform means and said frame, said platform positioning means disposed to define the angular orientation of said platform means relative to said frame, frame positioning means movably connected to said frame and extendable outwardly therefrom beyond said frame support means and into engagement with the inclined surface, said frame positioning means disposed for support and lateral movement of said frame when in its extended position; wherein said frame positioning means comprises at least one roller element, roller extension means adjustably interconnecting said one roller element to said frame, said one roller element configured and movably disposed to provide movement of said frame along the inclined surface in a direction substantially transverse to the longitudinal axis of said frame; and wherein said platform positioning means is movably positioned at least in part between said platform means and said frame, said platform means pivotally attached to said frame and said platform positioning means at spaced apart points therefrom, said point of connection between said platform means and said platform positioning means being extendable along the length of said platform positioning means, said platform means dimensioned and disposed to define the angular orientation of said platform means relative to said frame.

2. A support assembly as in claim 1 wherein said frame support means comprise at least two wheel elements movably connected to said frame in spaced apart relation and disposed in engagement with the inclined surface in movable, supportive relation to said frame upon disposition of said platform positioning means in its non-extended position.

3. A support assembly as in claim 2 wherein said two wheel elements are disposed in substantially aligned, in-line relation to one another and in movable, supportive engagement with the inclined surface relative said frame to accomplish movement of said frame in the direction of its longitudinal axis.

4. A support assembly as in claim 1 wherein said frame positioning means comprises a plurality of roller elements, said roller extension means adjustably inteconnecting each of said plurality of rollers elements to said frame, each of said roller elements configured and movably disposed to provide movement of said frame along the inclined surface in a direction substantially transverse to the longitudinal axis of said frame, each of said roller elements and each accompanying roller extension means positioned and spaced apart relative to one another on said frame and independently extendable into supportive relation to said frame on the inclined surface.

5. A support assembly as in claim 1 wherein said platform positioning means comprises an extension assembly movable along the length of said platform positioning means and being pivotally connected to said platform means, the opposite end of said platform means pivotally connected to said frame, said extension assembly disposed such that its position along the longitudinal axis of said platform positioning means defines the angular orientation between said frame and said platform means.

6. A support assembly in claim 1 further comprising attachment means secured to said frame and extending outwardly therefrom along substantially the leading portion thereof, said attachment means dimensioned and configured for interconnection between said frame and securement to the inclined surface.

7. A support assembly as in claim 1 further comprising scaffold connecting means integrally connected to said platform and disposed along one side thereof, whereby an end portion of the scaffold element is connected to the platform means along said one side thereof.

8. A support assembly designed to movably position a scaffold relative to an inclined surface, said support assembly comprising:

a frame;

at least one wheel coupled with said frame for permitting movement thereof in a first direction up and down said inclined surface;

a screw jack having two ends with a hand crank on a first one of said ends to permit extension and retraction of the other end thereof, said other end coupled to said frame;

a platform pivotable with respect to said frame and pivotably coupled to said screw jack between the ends thereof, said platform adapted to support said scaffold; and wherein operation of said hand crank moves said platform with respect to said frame.

9. The support assembly recited in claim 8 further comprising at least one roller coupled with said frame for permitting movement of said support assembly in a second direction substantially normal to said first direction.

10. The support assembly recited in claim 9 further comprising means for extending one of said wheel and said roller into and out of engagement with said inclined surface, said extension means being sufficient to permit raising of said frame away from said surface.

* * * * *